United States Patent [19]

Saulas

[11] Patent Number: 5,004,104

[45] Date of Patent: Apr. 2, 1991

[54] MULTI-UNIT PACKAGE PARTICULARLY FOR PARALLELEPIPED CARTONS

[75] Inventor: Alain Saulas, Chateauroux, France

[73] Assignee: The Mead Corporation, Dayton, Ohio

[21] Appl. No.: 502,606

[22] Filed: Mar. 30, 1990

[30] Foreign Application Priority Data

Mar. 30, 1989 [GB] United Kingdom ..... 8907185

[51] Int. Cl.[5] ..... B65D 5/04

[52] U.S. Cl. ..... 206/526; 206/434; 229/40; 229/117.12; 229/DIG. 9

[58] Field of Search ..... 206/140, 427, 428, 434, 206/526; 229/40, 117.12, 117.14, DIG. 9

[56] References Cited

U.S. PATENT DOCUMENTS

| | | | |
|---|---|---|---|
| 2,795,365 | 6/1957 | Currie | 206/427 |
| 2,811,250 | 10/1957 | Arneson | 206/428 |
| 2,987,176 | 6/1961 | Ringler | 229/DIG. 9 |
| 3,096,880 | 7/1963 | Farquhar | 206/427 |
| 4,685,566 | 8/1987 | Wilson | 229/DIG. 9 |

FOREIGN PATENT DOCUMENTS

| | | | |
|---|---|---|---|
| 0703658 | 2/1965 | Canada | 229/40 |

*Primary Examiner*—Jimmy G. Foster
*Attorney, Agent, or Firm*—Thomas A. Boshinski

[57] ABSTRACT

A package which accommodates a plurality of parallelepiped cartons includes a sleeve having a top wall panel and a bottom wall panel interconnected by spaced side wall panels thereby forming a tubular structure in which the parallelepiped cartons are accommodated. The tubular structure includes end wall panels which at least partially close the ends of the tubular structure. Corners of the sleeve each formed in part by a side wall panel and an adjacent end wall panel extend substantially the full height of the packaged cartons adjacent to such corners are each formed with a recess. The recesses of one sleeve are sized and positioned to receive said upper and lower corner portions of a like adjacent sleeve so that the adjacent sleeves can be nested when in flat form.

6 Claims, 1 Drawing Sheet

MULTI-UNIT PACKAGE PARTICULARLY FOR PARALLELEPIPED CARTONS

This invention relates to a multi-unit package which is particularly suitable for parallelapiped cartons sometimes referred to as 'brik' cartons. Such brik cartons are normally formed from a composite paperboard or like material having an inner fluid resistant lining and more usually containing a foodstuff or beverage such as fruit juice, milk or soups. Such brik cartons have walls which are relatively "soft" i.e. exhibit some give when pressure is applied to them but which recover to their previous disposition when the applied pressure is relieved.

There is a demand for the sale of such cartons in multiple units of, say, six cartons and the present invention is concerned with a retaining wrapper which holds together in a group a number of such brik cartons to provide a "carry home" package. The wrapper is designed to enhance the resistance to vertical loading of the package so that it is stronger when stacked during palletization. Moreover the wrapper is designed to provide a carrying handle and to give panel space on which advertising material can be presented.

One aspect of the invention provides a package which accommodates a plurality of parallelepiped cartons and comprises a sleeve including a top wall panel and a bottom wall panel interconnected by spaced side wall panels thereby forming a tubular structure in which said parallelepiped cartons are accommodated, said tubular structure including end wall panels which at least partially close the ends of the tubular structure wherein corners of the sleeve each formed in part by a side wall panel and an adjacent end wall panel extend substantially the full height of the packaged cartons adjacent to such corners and wherein upper and lower edges of each side wall panel adjacent upper and lower portions of said sleeve corners are each formed with a recess, said recesses of one sleeve being sized and positioned to receive said upper and lower corner portions of a like adjacent sleeve so that the adjacent sleeves can be nested when in flat form.

According to a feature of this aspect of the invention, said recesses and said corner portions may be complementary.

According to another feature of this aspect of the invention, said top wall panel and said bottom wall panel may comprise strips of material extending between said side wall panels said strips being shaped so that a pair of cooperating end closure panels of one sleeve can be nested with the top and bottom wall panels of a like adjacent sleeve when in flat form. In constructions where this feature is adopted, said top and bottom wall panels are of waisted form.

Another aspect of this invention provides a package which accommodates a plurality of parallelepiped cartons and comprises a sleeve including a top wall panel and a bottom wall panel interconnected by spaced side wall panels thereby forming a tubular structure in which said parallelepiped cartons are accommodated, said tubular structure including end wall panels which at least partially close the ends of the tubular structure, wherein upright corners of the sleeve each formed in part by a side wall panel and by an adjacent end wall panel extend substantially the full height of the packaged cartons adjacent to such corners and wherein a pair of cooperating end wall panels of one sleeve can be nested with respective ones of the top and bottom wall panels of a like adjacent sleeve when those sleeves are in flat form.

Yet another aspect of the present invention provides a pair of nested carton blanks each of which blanks is adapted to form a wrapper for accommodating a plurality of parallelepiped cartons and each of which comprises, in series, a first side wall panel, a top panel, a second side wall panel and a bottom panel hinged one to the next and wherein each side wall panel has an end closure panel hinged thereto at opposed end edges thereof, the hinged connection between an end closure panel and an adjacent side wall panel providing an upright corner of said wrapper and wherein opposite extremities of each corner of one blank are received in recesses formed in marginal edges of opposite side wall panels of a like adjacent blank thereby providing for the nesting of said adjacent blanks.

A still further aspect of the present invention provides a pair of nested carton blanks each of which blanks is adapted to form a wrapper for accommodating a plurality of parallelepiped cartons and each of which comprises, in series, a first side wall panel, a top panel, a second side wall panel and a bottom wall panel hinged one to the next and wherein each side wall panel has an end closure panel hinged thereto at opposed end edges thereof, and wherein a pair of cooperating end closure panels of one blank is received in nested relationship relative to the top and bottom wall panels of a like adjacent blank thereby providing for nesting of said adjacent blanks.

An embodiment of the invention will now be described, by way of example with reference to the accompanying drawings, in which.

Figure 2:
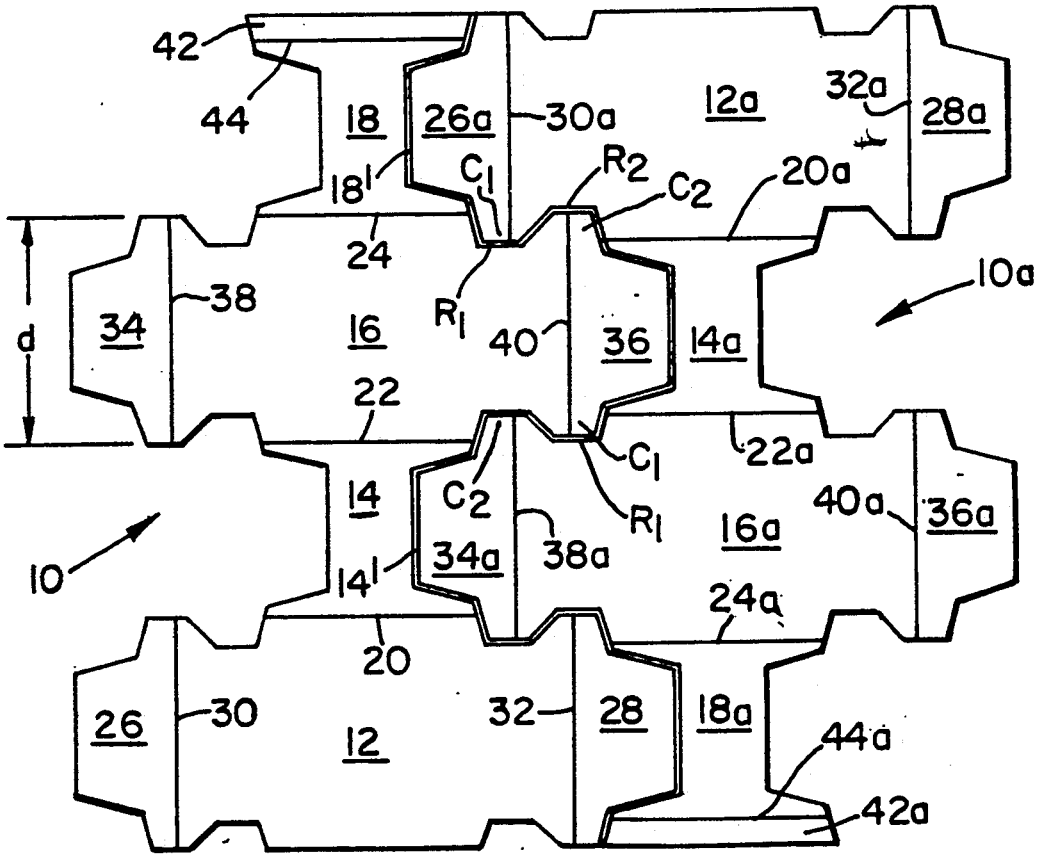
FIG. 2 is a plan view of a pair of like wrapper blanks, shown in nested relationship, from each of which the package in FIG. 1 can be assembled.

Referring to the drawings, the elongate blank 10 shown on the left side of FIG. 2 is formed from paperboard or like foldable sheet material and is shown in flat nested relationship with respect to a similar blank 10*a*. Like reference numerals in relation to blank 10*a* designate like part of blank 10 with the addition of suffix "a".

Wrapper blank 10 comprises a first side wall panel 12, a top wall panel 14, a second side wall panel 16 and a bottom wall panel 18 hinged one to the next along transverse fold lines 20, 22 and 24 respectively.

At each of the opposite transverse ends of side wall panel 12 is hinged an end wall panel 26 and 28 about longitudinal fold lines 30 and 32 respectively. Likewise, side wall panel 16 carries at each of its opposite transverse ends, end panels 34 and 36 hinged to side wall panel 16 about fold lines 38 and 40 respectively.

Figure 1:
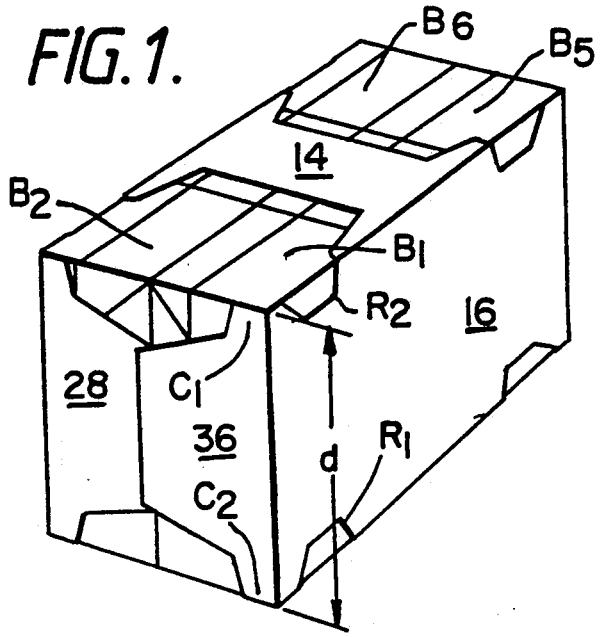
FIG. 1 is a multi-unit package according to the invention.

It will be seen that the top and bottom wall panels take the form of a "waisted" strip of material. This facilitates nesting of the blanks as described below and in the case of the top wall panel the "strip" provides a convenient handle by which the package can be carried. Bottom wall panel 18 has a securing flap 42 hinged thereto along transverse fold line 44. When the wrapper is applied to a group of brik cartons and formed into a sleeve, the securing flap 42 is glued or otherwise secured to the free (lower) transverse marginal edge of side wall panel 12. The completed package is shown in FIG. 1 where a group of six carton briks are maintained in a unit by a wrapper blank of the type described. The ends of the tubular structure formed by the wrapper are closed partially by cooperating end closure panels 26, 34 and 28, 36 respectively, each cooperating pair being secured in overlapping relationship.

In order to allow blanks to be struck from a web of paperboard stock with a minimum of material wastage, various of the panels of the blanks are shaped in such a way that adjacent blanks can be nested head to toe, as shown in FIG. 2. Thus, the top wall (handle) panel 14 and the bottom wall panel are of waisted configuration thereby to be nestable with respect to the end wall panels of adjacent blanks which are of complementary form. For example, in FIG. 2, end wall panels 26*a* and 34*a* are each shown engaged in a respective complementary recess 14', 18' which are defined by end edges of panels 14, 18 respectively by virtue of their shape.

At the corners of the package illustrated in FIG. 1, the wrapper is co-extensive with the cartons so that dimension 'd' of the wrapper carton is substantially equivalent to the height of the adjacent packaged carton 'B1'. By the provision of such a 'full height' corner construction, the stacking strength of the package is enhanced because the vertical compressability of the package as a whole is improved so that crushing of the brik cartons is resisted. It is, of course, possible to have the height of each side wall throughout its length equivalent to dimension 'd' but such a carton design detracts from the full nesting of adjacent blanks. Thus, each side wall at its upper and lower edges is formed with a recessed portion adjacent each corner of the wrapper. For example, the upper and lower corner parts C1, C2 of the package formed from blank 10, adjacent carton B1 (FIG. 1) nest into complementary recesses R1 and R2 formed in side walls 16*a* and 12*a*, respectively of blank 10*a* when the blanks are struck from the paperboard web. Hence, upper corner portion C1 of blank 10*a* is nested into recess R1 of the blank 10 and lower corner portion C2 of blank 10 is nested into recess R2 of blank 10*a* whereby the upper and lower portions C1, C2 of nested blank lay adjacent one another. With this arrangement the end closure panels of one blank can be virtually fully nested with a like adjacent blank whilst also providing a full height corner structure for the package.

I claim:

1. A pair of nested carton blanks, each of said blanks being adopted to form a package for accommodating a plurality of parallelepiped cartons, and comprising:

a top wall panel;

a bottom wall panel;

a pair of spaced side wall panels interconnecting said top wall panel and said bottom wall panel to form a tubular structure in which said parallelepiped cartons may be accommodated, each of said side wall panels having upper, lower and end edges;

an end wall panel connected to each of said end edges to at least partially close the ends of said tubular structure;

said tubular structure having corners formed by one of said side wall panels and an adjacent one of said end wall panels, said corners defining upper and lower corner portions and extending a full height of the cartons to be accommodated therein;

each of said upper and lower edges of each of said side wall panels defining a recess into said side wall panel adjacent each of said corners;

said recesses each being sized and positioned to correspond to said upper and lower corner portions, whereby said recesses of one of said blanks may receive said upper and lower corner portions of another one of said blanks so that said blanks may be nested when in a flat form.

2. A package including a wrapper and a plurality of substantially identical parallelepiped cartons of a predetermined height, said wrapper comprising:

a top wall panel;

a bottom wall panel;

a pair of spaced side wall panels interconnecting said top wall panel and said bottom wall panel to form a tubular structure in which said parallelepiped cartons may be accommodated, each of said side wall panels having upper, lower and end edges;

an end wall panel connected to each of said end edges to at least partially close the ends of said tubular structure;

said tubular structure having corners formed by one of said side wall panels and an adjacent one of said end wall panels, said corners defining upper and lower corner portions and extending said height of said cartons to be accommodated therein;

each of said upper and lower edges of each of said side wall panels defining a recess into said side wall panel adjacent each of said corners;

said recesses each being sized and positioned to correspond to said upper and lower corner portions, whereby said recesses of said wrapper may receive said upper and lower corner portions of an adjacent and substantially identical wrapper so that said wrappers may be nested when in a flat form.

3. A package according to claim 2, wherein said recesses and said corner portions are complementary.

4. A package according to claim 2, wherein said top wall panel and said bottom wall panel comprise strips of material extending between said side wall panels, said strips being shaped so that a pair of cooperating ones of said end wall panels of said wrapper can be nested with said top and bottom wall panels of said adjacent wrapper when in flat form.

5. A package according to claim 4, wherein said top and bottom wall panels are of a waisted form.

6. A package including a wrapper and a plurality of substantially identical parallelepiped cartons of a predetermined height, said wrapper comprising:

a top wall panel;

a bottom wall panel;

a pair of spaced side wall panels interconnecting said top wall panel and said bottom wall panel to form a tubular structure in which said parallelepiped cartons may be accommodated, each of said side wall panels having upper, lower and end edges defining a width extending between said edges;

an end wall panel connected to each of said end edges to at least partially close the ends of said tubular structure;

said tubular structure having corners formed by one of said side wall panels and an adjacent one of said end wall panels, said corners defining upper and lower corner portions and extending said height of said the cartons to be accommodated therein;

said top and said bottom panels each having a width less than said width of said side wall panels;

each of said end wall panels, said top and said bottom panels being formed whereby an end wall panel of said wrapper may be positioned adjacent one of said top and said bottom panels of an adjacent and substantially identical wrapper so that said wrappers may be nested when in a flat form.

* * * * *